US008545679B2

(12) United States Patent
Cauley et al.

(10) Patent No.: US 8,545,679 B2
(45) **Date of Patent: *Oct. 1, 2013**

(54) SYSTEM AND METHOD FOR RECOVERY OF HYDROCARBONS IN TAR SANDS

(75) Inventors: Phillip L. Cauley, Bullard, TX (US); Tracy L. Edwards, Flint, TX (US)

(73) Assignee: Efficien Technology, LLC, Doraville, GA (US)

( * ) Notice: Subject to any disclaimer, the term of this patent is extended or adjusted under 35 U.S.C. 154(b) by 859 days.

This patent is subject to a terminal disclaimer.

(21) Appl. No.: 12/639,322

(22) Filed: Dec. 16, 2009

(65) Prior Publication Data

US 2010/0147671 A1 Jun. 17, 2010

Related U.S. Application Data

(63) Continuation of application No. 11/512,791, filed on Aug. 30, 2006, now Pat. No. 7,641,770.

(51) Int. Cl.
*C10B 49/00* (2006.01)

(52) U.S. Cl.
USPC ..... 202/100; 202/105; 202/211; 110/110; 110/229; 110/242

(58) Field of Classification Search
USPC ..... 202/100, 105, 211, 218; 422/190; 110/229, 242, 110, 101 R, 190, 118, 219, 110/239, 101 CC; 73/40
See application file for complete search history.

(56) References Cited

U.S. PATENT DOCUMENTS 4,077,868 A * 3/1978 Chambers ..... 585/242
4,280,879 A 7/1981 Taciuk
4,285,773 A 8/1981 Taciuk
4,389,794 A 6/1983 Bitterly
4,439,209 A 3/1984 Wilwerding et al.
4,452,154 A * 6/1984 Kono et al. ..... 110/346
4,624,417 A 11/1986 Gangi
4,639,217 A 1/1987 Adams
4,769,149 A 9/1988 Nobilet et al.
4,857,458 A 8/1989 Nobilet et al.
4,872,949 A 10/1989 Wilwerding
4,882,903 A 11/1989 Lowry, Jr. et al.
5,143,000 A * 9/1992 Camacho ..... 110/250
5,411,714 A * 5/1995 Wu et al. ..... 422/232
5,423,456 A * 6/1995 Arendonk et al. ..... 222/54
5,429,645 A 7/1995 Benson et al.
5,720,232 A * 2/1998 Meador ..... 110/346
5,915,308 A * 6/1999 May et al. ..... 110/165 R
5,996,512 A 12/1999 Morin et al.
6,133,491 A 10/2000 Xing
6,165,349 A 12/2000 Madar (Continued)

*Primary Examiner* — Nina Bhat
*Assistant Examiner* — Jonathan Miller
(74) *Attorney, Agent, or Firm* — Streets & Steele

(57) ABSTRACT

A system for recovering hydrocarbons from tar sands includes a heated enclosure 66, one or more input conveyors 60, 67 move tar sands through the heated enclosure, provide a flow line with a temperature gradient of at least 150 F.°, and mechanically move the tar sands along the flow line. A heated rotary drum 74 is in fluid communication with the flow line, and condenser unit 94, 98 receive vapors from the flow line and the rotary drum and output hydrocarbons. One or more discharge conveyors 76 discharge stripped sands from the rotary drum. Control valves 80, 82 seal a vacuum downstream from the discharge conveyors, and control valves 34, 46 seal vacuum upstream from the one or more input conveyors. Various types of vacuum pumps may be used to maintain a selected vacuum between the control valves.

18 Claims, 7 Drawing Sheets

(56) References Cited

U.S. PATENT DOCUMENTS

| | | | |
|---|---|---|---|
| 6,848,357 | B2 | 2/2005 | Linnonmaa et al. |
| 6,938,562 | B2 | 9/2005 | Pope |
| 7,008,528 | B2 | 3/2006 | Mitchell et al. |
| 7,264,694 | B2 | 9/2007 | Merrell et al. |
| 2004/0103831 | A1 | 6/2004 | Pope |
| 2004/0192980 | A1 | 9/2004 | Appel et al. |

* cited by examiner

SYSTEM AND METHOD FOR RECOVERY OF HYDROCARBONS IN TAR SANDS

RELATED CASE

This application is a continuation of U.S. Ser. No. 11/512,791 filed Aug. 30, 2006 now U.S. Pat. No. 7,641,770.

FIELD OF THE INVENTION

The present invention relates to equipment and techniques for recovering hydrocarbons from tar sands, wherein a heated enclosure and a condenser operate under a selected vacuum maintained by a vacuum pump. Tar sands are moved through the heated enclosure in a first direction, while hydrocarbon vapors are drawn toward the condenser in an opposing second direction.

BACKGROUND OF THE INVENTION

Various types of devices have been experimentally and commercially used for recovering hydrocarbons from tar sands. Other devices are particularly intended for disposing of solid waste, such as rubber particles from used tires. One type of experimental device utilized a heated enclosure with an interior chamber and a conveyor for inputting tar sands to the heated enclosure. A condenser received vapors from the heated enclosure and output liquid hydrocarbons and gas hydrocarbons. Vacuum pumps have been used in some experimental units to maintain a selected vacuum within the heated enclosure, such that hydrocarbon vapors are drawn from the heated enclosure to the condenser. The prior art systems known to Applicants contain no effective way of monitoring the vacuum within the system at potential leak sites. Conventional packing was used on the end of auger tube shafts to maintain a vacuum.

Prior art systems for recovering hydrocarbons from tar sands include U.S. Pat. Nos. 4,624,417; 4,769,149; 4,857,458; 4,882,903; 5,429,645; 5,996,512; 6,938,562; and 6,848,375, as well as Patent Application Publications 2004/0103831 and 2004/0192980.

The disadvantages of the prior art are overcome by the present invention, and an improved system and method are hereinafter disclosed for recovering hydrocarbons from tar sands.

SUMMARY OF THE INVENTION

In one embodiment, a system for recovering hydrocarbons from tar sands comprises a heated enclosure having an interior chamber and a plurality of internal baffles within the heated chamber, one or more input conveyors for inputting tar sands to the heated enclosure, and a flow line within the heated enclosure in fluid communication with the one or more input conveyors for receiving tar sands and positioned with respect to the plurality of baffles to provide a temperature gradient along the flow line of at least 150 F.°, thereby producing hydrocarbon vapors and residual solids. A heated conveyor within the flow line mechanically moves the tar sands and the residual solids along the flow line. A heated rotary drum is provided in fluid communication with the flow line for receiving the tar sands and the residual solids, with the rotary drum having an interior temperature of from 730° F. to 800° F. for generating hydrocarbon vapors and stripped sand. A condenser is in fluid communication with the flow line and the rotary drum for receiving the vapors from the flow line and the rotary drum and outputting liquids including hydrocarbons and gas including hydrocarbons. One or more discharge conveyors are provided for discharging the stripped sand from the rotary drum. Two or more input control valves are each positioned along the one or more input conveyors for sealing vacuum downstream from the one or more input conveyors, with each input control valve having two or more axially spaced closure gates. Similarly, two or more discharge control valves are positioned along the one or more discharge conveyors for sealing vacuum upstream from the one or more discharge conveyors, with each discharge control valve having two or more axially spaced closure gates. A vacuum pump maintains a selective vacuum of less than 5 inches of water between the two or more input valves and the two or more discharge valves, such that hydrocarbon vapors are drawn from the flow line and the rotary drum into the condenser.

In another embodiment, the system for recovering hydrocarbons from tar sands includes a heated enclosure, one or more input conveyors, a flow line within the heated enclosure, a heated conveyor within the flow line, a rotary drum, a condenser, one or more discharge conveyors, one or more input control valves, and one or more discharge control valves. Each of the one or more input conveyors, the one or more discharge conveyors, and the conveyor within the flow line includes a rotary auger. Each rotary auger is rotated by a drive motor and a gearbox, with a seal engaging a rotary shaft connected to each auger for sealing vacuum, and a back-up sealed enclosure downstream from the seal for sealing the auger seal from atmosphere. A vacuum pump maintains a selective vacuum of less than 5 inches of water within the condenser, such that hydrocarbon vapors are drawn from the flow line into the condenser. A plurality of leak detector sensors detect a leak within the vacuum system between the one or more input control valves and the one or more discharge control valves. A flow meter is provided for measuring a flow rate of hydrocarbon vapors to the condenser. A processor is provided for controlling the rotational rate of each rotary auger in response to the flow meter and the plurality of leak detector sensors.

These and further features and advantages of the present invention will become apparent from the following detailed description, wherein reference is made to the figures in the accompanying drawings.

DETAILED DESCRIPTION OF PREFERRED EMBODIMENTS

A system according to the present invention is well suited for recovering hydrocarbons from tar sands. Those skilled in the art will appreciate, however, that the system and method disclosed herein may be used to convert various other types of materials, including waste materials, into energy.

Figure 1:
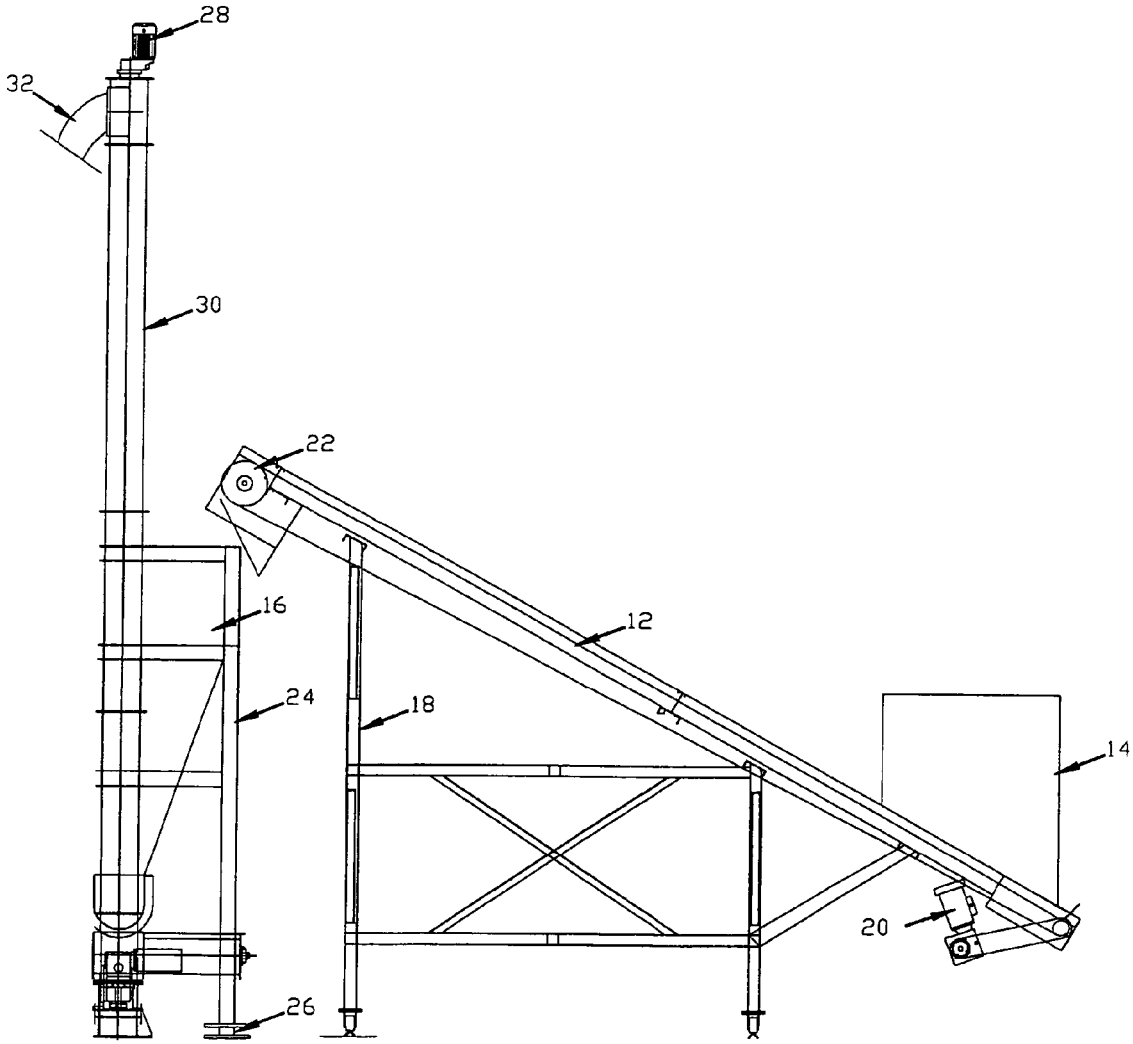
FIG. 1 is a side view belt of a conveyor and vertical auger for initially feeding tar sands into a heated enclosure.

FIG. 1 illustrates a belt conveyor 12 which may be used to convey tar sands from an initial dump hopper 14 into a staging hopper 16. The conveyor 12 may be supported on a suitable frame structure 18, with a motor and gearbox assembly 20 used to power the conveyor 12. A magnetic drum 22 is provided adjacent a discharge end of the conveyor 12 for minimizing the amount of metal input to the hopper 16.

The hopper 16 may be provided with a support structure 24 which includes a plurality of load cells 26 for measuring the weight of the material in the hopper. Since the conveyor 12 may be powered only intermittently as need to maintain material in hopper 16, periodic measurements from the load cells 26 may thus be used to calculate the amount of material being input to the system over time. Material from the hopper 16 is input to the vertical auger conveyor 30, which is powered by a drive unit 28. Material is discharged from the upper end of the auger conveyor 30 to discharge pipe 32, which flows into the double-dump valve 34 (see FIG. 2) which includes a pair of axially spaced gates 36, 38. One of the gates 36, 38 is normally closed when the other gate is open, thereby providing a seal for the vacuum downstream from the valve 34.

Tar sands passing through the valve 34 is input to auger conveyor 40, which houses a conventional screw-type auger 42 rotated by drive motor and gearbox assembly 44. Material discharged from conveyor 40 passes through a roto disc valve 46, which also has a pair of axially spaced gates 48, 50. Material passing through the valve 46 is input to another conveyor 52 having an internal auger 54 powered by a motor and gearbox assembly 56. A suitable double dump valve 34 is the Model H-0822-11 valve manufactured by Plattco, and a suitable roto disc valve is the Model RD-5402-1 valve manufactured by Roto-Disc.

The Roto-Disc valve 46 is in series with the double-dump valve 34, which in turn is in series with the substantially vertical auger conveyor 30. This system provides three separate mechanisms for maintaining a vacuum within the system while allowing tar sands to pass into the system, with the valves 46 and 34 each including a pair of axially spaced gates. Any gas which bypasses the valves 46 and 34 is thus substantially plugged within the system by the tar sands within the vertical auger 30. The plugging effect of the materials in the vertical auger conveyor 30 along with the valves 34, 46 thus provide at least a triple redundancy to maintain vacuum within the system.

Figure 2:
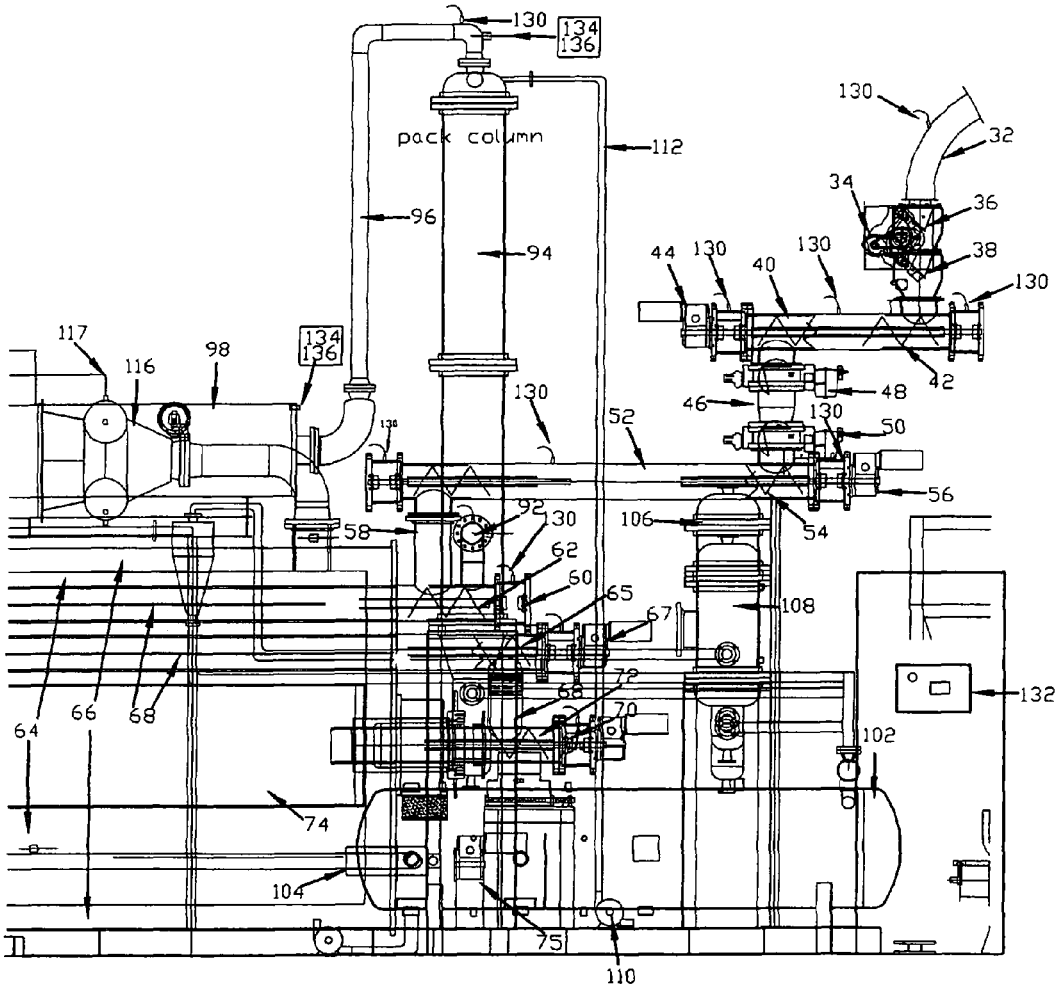
FIG. 2 is a side view of additional conveyors, a portion of a heated enclosure and a condensing column.
Figure 3:
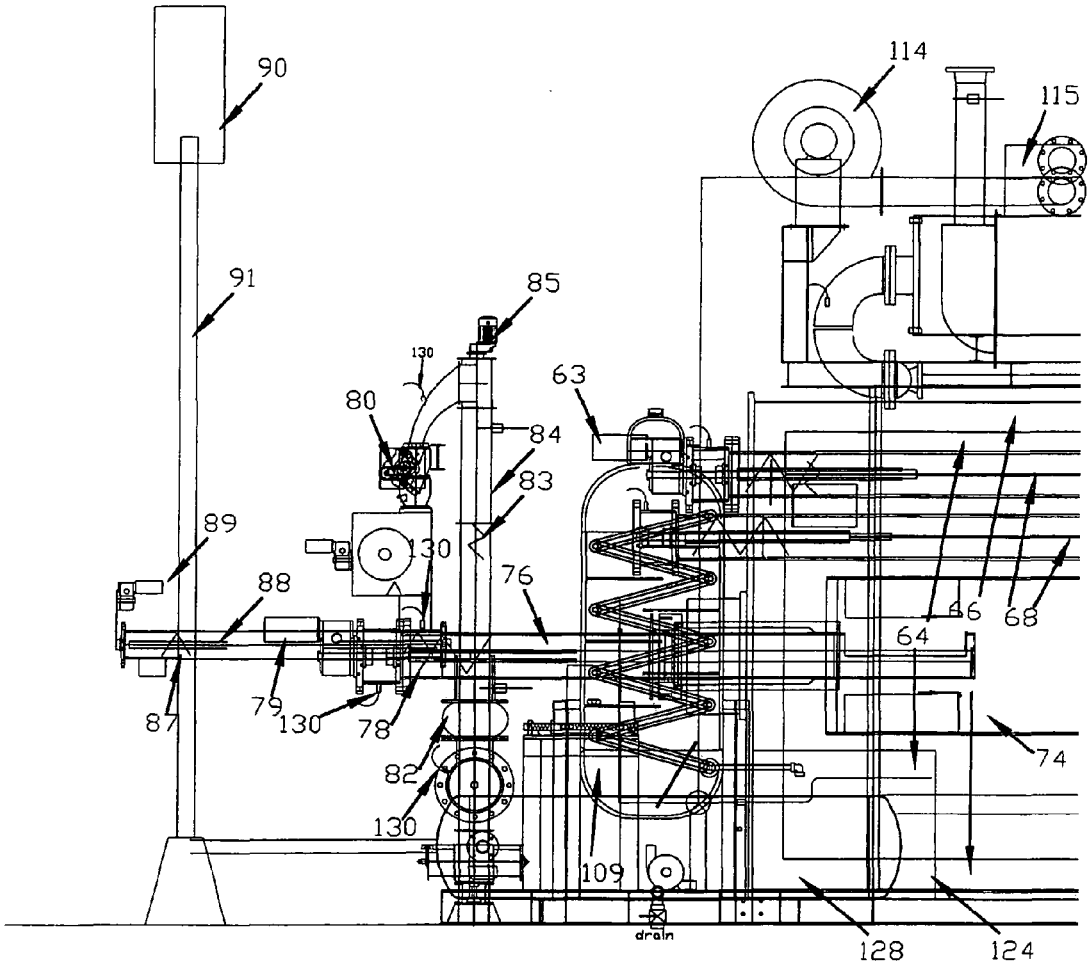
FIG. 3 is a side view of another portion of the condensing column and heated enclosure, as well as a discharge conveyor and a flare stack.

Referring still to FIG. 2, tar sands are discharged from the auger conveyor 52 into the conduit 58, where it drops by gravity into the horizontal conveyor 60 with an auger 62 powered by motor and gearbox assembly 63 (see FIG. 3). Conveyor 60 and the auger 62 in turn are received within the interior chamber 64 of the heated enclosure 66, which includes a plurality of baffles 68 for maintaining a desired temperature profile within the heated enclosure. Material passing through the conveyor 60 is thus heated to produce hydrocarbon vapors and residual solids. More particularly, material passes through the conveyor 60 to the left as shown in FIG. 2, and then drops to a similar conveyor 67 which includes an auger 65 for moving material to the right, as shown in FIG. 2. If desired, another conveyor may be in parallel with conveyor 67 to increase the surface area of exposed material. Conveyor auger 65 may be powered by motor and gearbox assembly 63. Conveyors 60 and 67 form a flow line positioned with respect to the plurality of baffles to provide a temperature gradient along the low line of at least 150 F.°, while the augers mechanically move the tar sands and stripped sands through the flow line. Material discharged from the conveyor 67 drops by conduit 68 to yet another horizontal conveyor 70, which similarly has an auger 72 powered by motor and a similar gearbox assembly 63. At a volume of about 2,000 pounds of tar sands per hour, the desired reaction time of the tar sands in the auger is about 15 minutes.

Conveyor 70 reintroduces the material into the heated enclosure 66, and more particularly into rotary drum 74 which may be rotated by drive unit 75. The heated rotary drum 74 is thus in fluid communication with the flow line formed by the conveyors 60 and 67, and receives tar sands and residual solids from the flow line. Accordingly to the present invention, the interior temperature within the rotary drum 74 is maintained at from 760° F. to 840° F., and preferably from 780° F. to 820° F., for generating hydrocarbon vapors and stripped sand. This reactor temperature is the result of input steam and heat generated by burner 104.

As shown in FIG. 3, material discharged from the rotary drum 74 is input to the conveyor 76, which also includes an auger 78 powered by motor and gearbox assembly 79. Sand discharged from the conveyor 76 is passed downward through a roto disc valve 82, then upward through a vertical conveyor 84, where the stripped sands within the conveyor 84 acts as a plug to assist in maintaining vacuum in the system. The auger 83 in the vertical conveyor 84 is powered by motor and gearbox assembly 85. Material discharged from the conveyor 84 passes downward through a double dump valve 80, and is finally discharged through conveyor 88 with auger 87 powered by a similar drive. A nitrogen supply system 89 supplies nitrogen to the stripped sand discharged from the conveyor 88. Dry cooled nitrogen may thus be fed through the stripped sands exit assembly on the conveyor 88 to provide an inert atmosphere for neutralizing the volatility of the hot hydrocarbons and to cool these solids. A bag type dust collecting filtration system (not shown) may be used to reduce dust from the discharge carbon block solids. Any remaining gases may exit the conveyor 88 through the vertical stack 91, and be burned in flare chamber 90, although flaring may only be necessary in the event of an emergency.

Returning again to FIG. 2, hydrocarbon vapors from the conveyors 62 and 67 may pass by conduit 92 into the condensing column 94, which may then pass uncondensed vapors via line 96 to condenser 98. Accordingly to the present invention, the condensing column 94 may be provided upstream from the condenser 98 for initially separating liquids and gases, and hydrocarbon vapors are input into a lower portion of the condensing column. Hydrocarbon vapors thus travel by vacuum in an opposite direction of the feed material through the conveyor 62. The condensing column 94 may utilize stainless steel pall rings to provide the surface area desired to start the first step of condensing.

Hydrocarbon vapors leaving the condenser 98 may be passed to a demister 106, and then to a vacuum liquid ring or gas scrubber 108. A majority of the hydrocarbon vapors are liquefied in condensing column 94, and further vapors are condensed in condenser 98. The demister 106 and the liquid ring 108 remove substantially the remaining portion of the gas vapors, so that any gas discharged from the gas chiller 109 may serve as a feedstock to the burner 104, or may be passed to a pipeline or storage tank. The gas chiller may be provided with a vacuum pump for dropping remaining heavy hydrocarbons to a liquid form. The remaining gas may be directed to the burner of the heated enclosure. A water/oil separator 102 may be provided for separating liquid carbons from water, with most of the water occurring as a result of the steam input to the heated enclosure. The reflux pump 110 may be provided for inputting a relatively low volume of oil to the top of the column 98 through the flux line 112, with this oil acting as a quenching material to enhance the condensing process. A blower 114 (see FIG. 3) may be provided for inputting air to the burner 104 within the heated enclosure 66, and may be passed through the air to air heat exchanger 115 to warm the air before entering the heat enclosure, thereby increasing efficiency.

Figure 4:
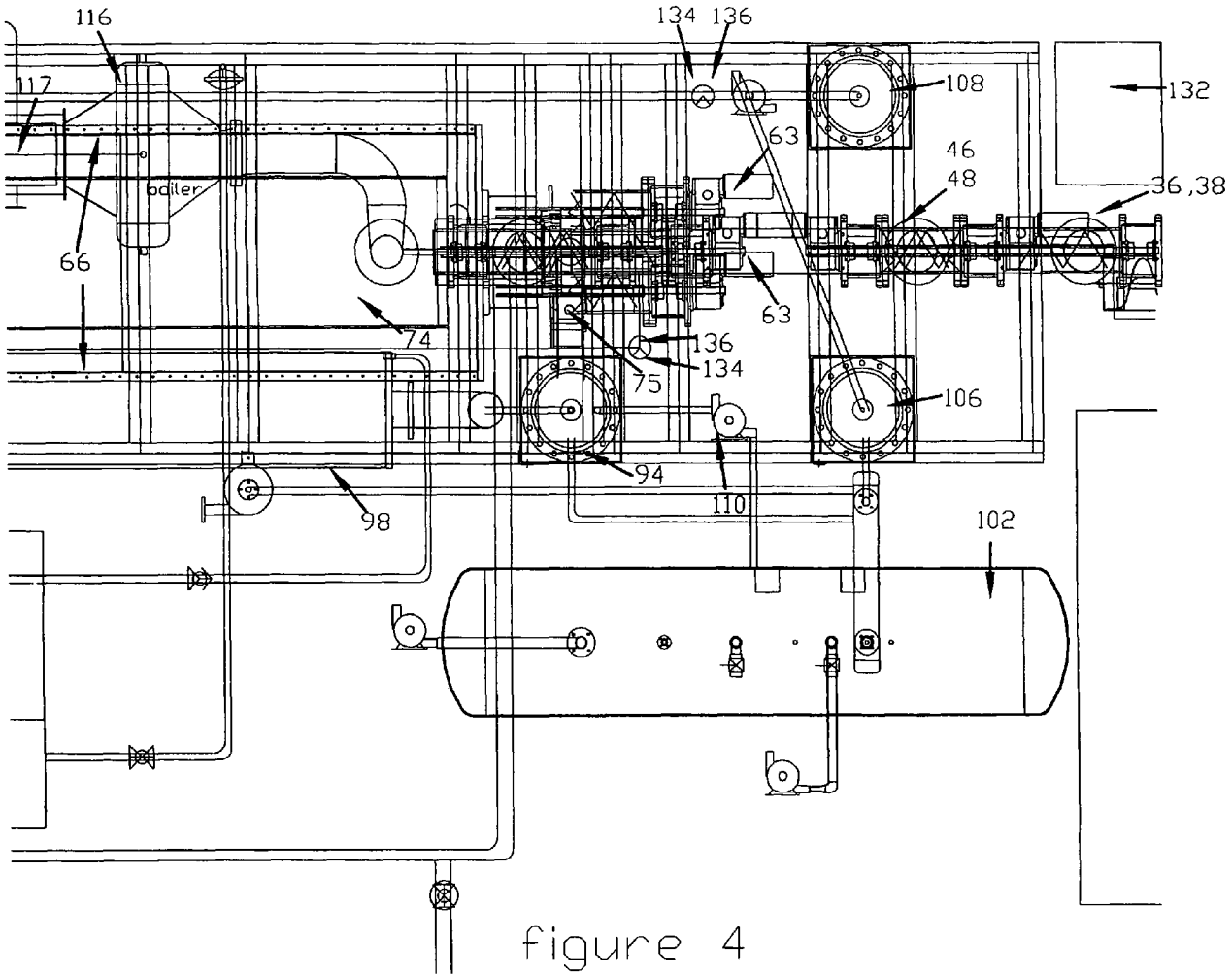
FIG. 4 is a top view of the equipment shown in FIG. 2.

A boiler 116 (see FIG. 4) preferably powered by the hydrocarbons produced by the system may receive treated water and produce a relatively low volume, high temperature steam, which is preferably at a temperature at from 300° F. to 500° F. into the rotary drum 74 for stripping remaining hydrocarbons from the material. For processing 2,000 pounds of tar sands per hour, from 0.2 to 0.4 pounds of steam per minute may be input to the reactor at a pressure of from 3 to 5 PSI. FIG. 4 is a top view of the equipment shown in FIG. 2, and more particularly illustrates a heated flowline 117 from the enclosure 66 to a boiler 116, which produces steam which is input to the enclosure. Relatively low pressure, high temperature steam is thus input to the heated enclosure.

The introduction of high temperature steam to the tar sands results in a steam reformation or "gasification" of hydrocarbons from the tar sands. Most importantly, however, the steam reformation preferably occurs for tar sands in a reactor operating in the range of from 780-820° F., which is substantially lower than temperatures conventionally used for steam reformation operations. Also, the present invention does not rely upon a nickel catalyst to perform the steam reformation, and instead uses T1 high carbon steel material for a substantial portion if not all the material contacting the tar sands while within the heated enclosure. The reaction chamber housing and the auger flights are thus fabricated from the T1 material. The T1 material enhances ion transfer, which allows the steam reformation to efficiently occur at a desired lower temperature. During long term operation of the reactor, the reaction chamber housing changes its metallic makeup into a magnetic ferrite as a result of the ion transfer.

Figure 5:
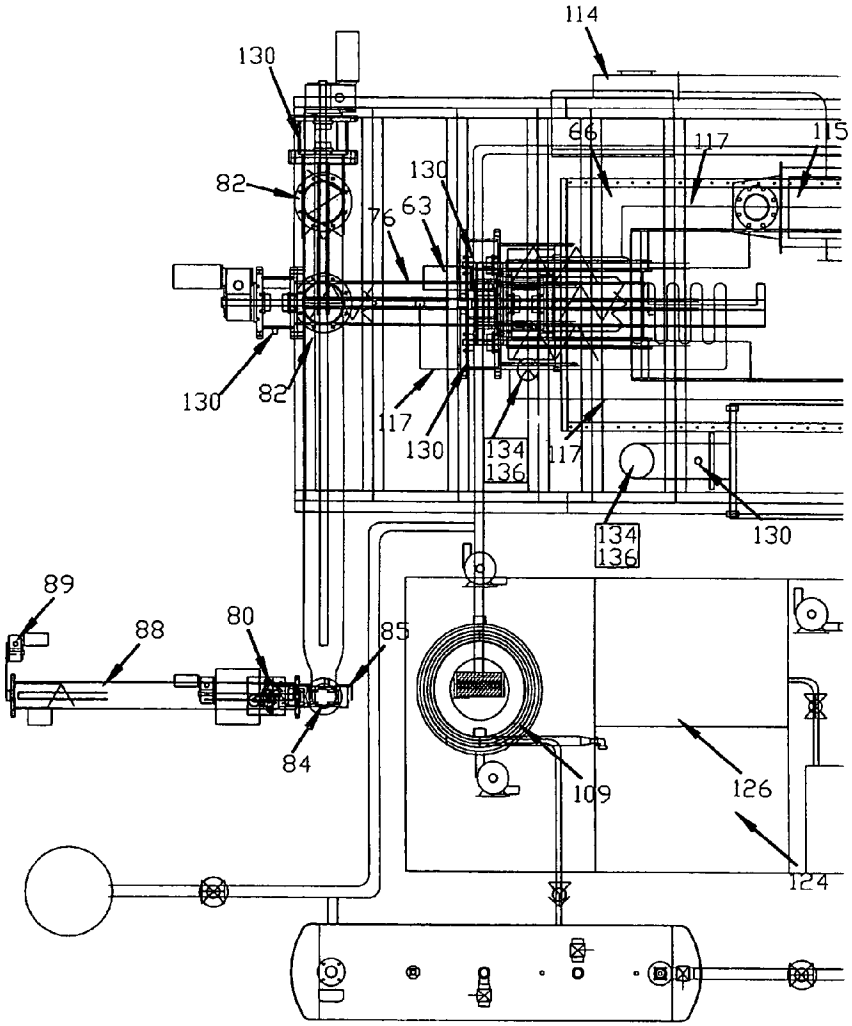
FIG. 5 is a top view of the equipment shown in FIG. 3.

A refrigeration unit 124 as shown in FIG. 3 may be provided for gas and water cooling. A separate water chiller 126 (see FIG. 5) may also be provided, and a gas accumulator tank 128 is also shown in FIG. 4.

Temperature and/or vacuum sensors 130 may be provided at the various locations in the system to quickly identify leaks, and to quickly locate a leak, and to provide a temperature of the material at this stage of the process. Signals from each of the signals may thus be input to a master control station 132 shown in FIGS. 2 and 4, which includes one or more conventional computers. One or more digital flow meters 134 and digital pressure switches 136 may be provided for measuring the flow rate of gas to the condenser column or the flow rate of gas to various other pieces of the system, with the pressure switches providing an accurate reading of the pressure at selected locations within the system. The system may include digital flow meters and digital pressure gauges that will communicate with the computer.

The conveyors within the heated enclosure may thus be operated with a level of one third material or less within each auger conveyor to increase the surface area of exposed material. The material may be retained within the enclosure 66 during a retention time of less than 15 minutes, and typically more than 8 minutes. The retention time of from 10 to 12 minutes will be appropriate for many materials.

Figure 6:
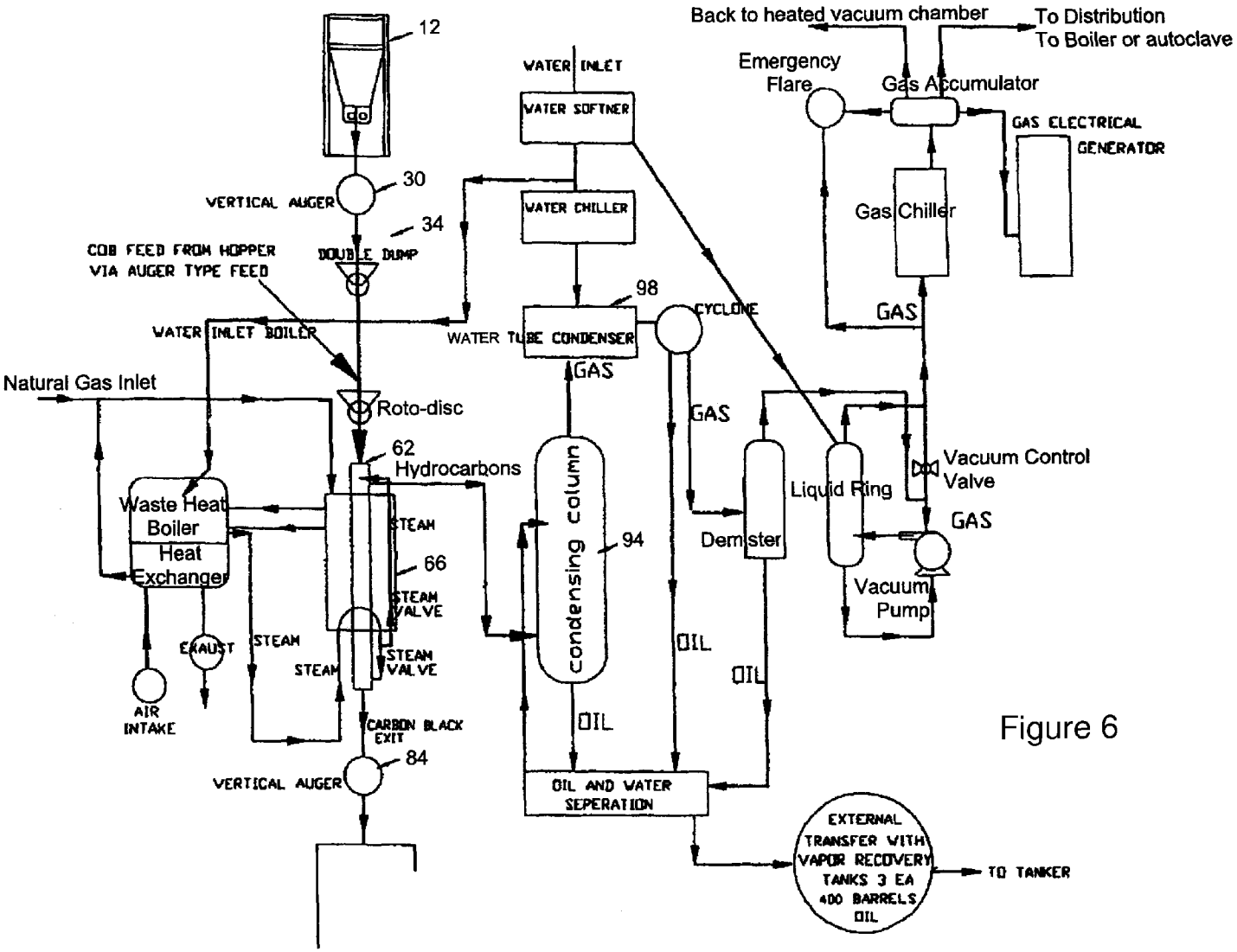
FIG. 6 is a schematic representation of a suitable system according to the present invention.

FIG. 6 illustrates many of the primary components of the system in schematic form. Material from the conveyor 12 thus passes upward through the vertical auger 30, through the double-dump valve 34, and through the conveyor 62 into the heated enclosure 66. Stripped sand discharged from the enclosure is passed through the vertical auger 84 and may then be shipped to a land fill.

Hydrocarbons discharged from the heated enclosure 66 pass to the condensing column 94, with gas continuing to the water tube condenser 98, and are then input by a cyclone pump to a demister, and finally to a gas chiller. A liquid ring with a vacuum pump may be spaced fluidly between the fragmentator and the gas chiller. Other than the gas released through an emergency flare, gas from the chiller may be input to a gas accumulator, and to a gas electrical generator. Some of the gas may be returned to the heated enclosure, and other gas may pass to the boiler. Produced hydrocarbons may thus be recovered in holding tank 102, and may be passed to a burner 104 within the heated enclosure 66 to generate heat. The system may thus primarily run on its own produced gas once the reaction starts to occur.

A water condenser is provided with internal coils preferably fabricated from stainless steel. Water may be treated with a water softening system and will be continuously circulated through a water chiller while flowing through the condenser to maintain a constant temperature and reduce the rate of corrosion. The water softener may be used to input water to the liquid isolation chamber, and also the waste heat boiler. Steam from the boiler may be input to the heated enclosure 66, as discussed above. The oil and water separator 102 may receive oil and water from various locations in the system, but primarily from the condensing column 94.

Each of the conveyors with augers therein may include a machine shaft seal, a shaft housing, a direct drive motor, and a gearbox. The motor may be a hydraulic, pneumatic or electrically powered motor 144, and may drive a gearbox 146 or another transmission device. The auger motor may include a programmable drive which monitors amperage and rpms of the auger, and may thus be tied to a master computer.

Figure 7:
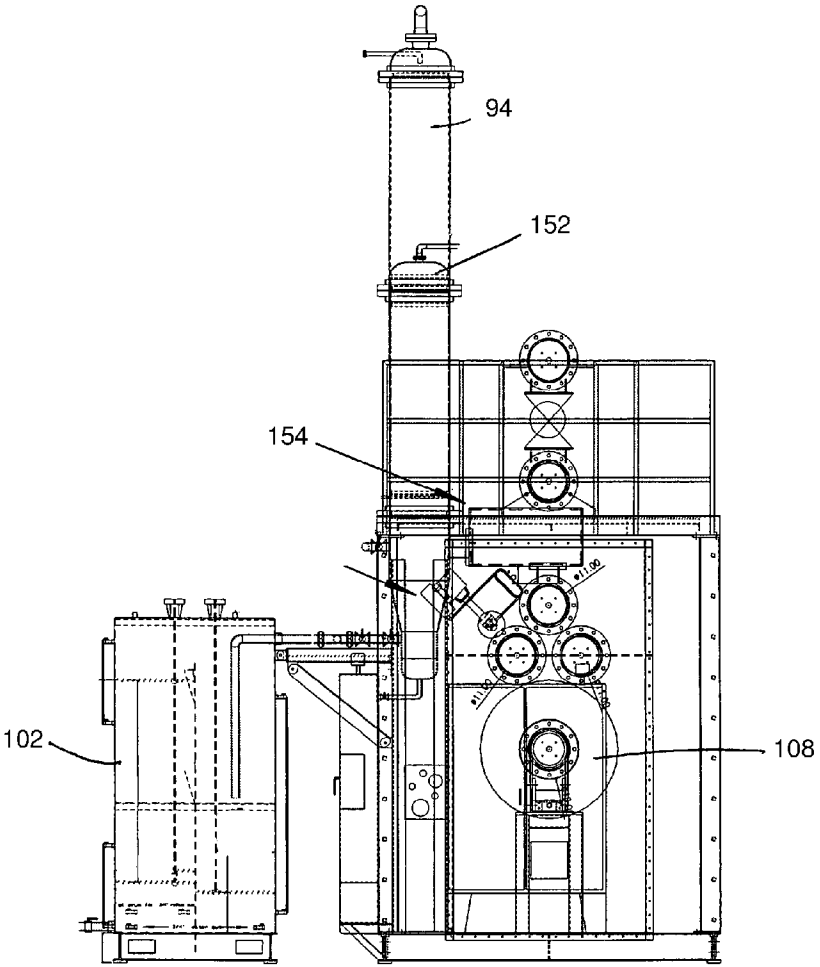
FIG. 7 is an alternate embodiment of some of the equipment shown in FIG. 2.

FIG. 7 illustrates an alternate embodiment of a portion of the equipment discussed above. A pack column 94 and oil-water separator 102, and a vacuum liquid ring or gas scrubber 108 are provided. Another mister 152 may be provided in the pack column 94, and may be in communication with the liquid ring 108 to provide for a vapor exit. Tar sands or other input material may then be input to the mister 152.

FIG. 7 also illustrates a velocity reduction box 154 which is provided upstream of the pack column 94. The velocity reduction box provides a large cross section flow chamber so that the velocity of the vapors entering the pack column are reduced, thereby allowing particles to drop out by gravity and reducing the likelihood of plugging the pack column.

The present invention may sufficiently convert various materials, including but not limited to tar sands, energy and non-energy byproducts. In addition to tar sands as disclosed herein, the invention may be used to convert solid waste, sewage sludge, animal waste, trash and refuge, solid industrial waste, coal or other solid fossil fuels into energy. Waste plastics and waste fat from animals, fryer oils and other food processing wastes may also be converted into useful products according to the present invention. The system avoids many of the problems of prior attempts to efficiently convert tar sands into energy by avoiding the requirement of a fluidized bed or other special reactions. The stripped sand is much cleaner than sand produced in prior art systems, and little or no further effort need be expended prior to disposal of the stripped sand according to this invention. The system of the present invention is relatively compact and may be placed in a small location, with the emissions from the system being relatively clean and non-hazardous. By providing a system which is essentially operating under a vacuum, the likelihood of inadvertent release of gases is minimized, while the vacuum pump draws the hydrocarbon vapors, preferably in a counter flow direction from the particles moving through the system, toward the condenser units.

The term "tar sands" as used herein refers to subterranean soil, e.g., sand, which contains heavy oil or other hydrocarbons therein. Tar sands can be mined and the useful hydrocarbon products extracted, and then the stripped sands returned for landfill. Most importantly, extracted hydrocarbons may be substantially reformed, so that the resultant product is substantially thinner and has a significantly higher viscosity than the oil contained in the sands. This allows the product to be more easily pumped or otherwise transported, and requires less chemical operations to crack the hydrocarbons to obtain commercially useful products. Also, the stripped sands are free, or substantially free, of hydrocarbons once passed through the equipment, so that the environmental impact of returning the stripped sands to landfills is more positive.

A particular feature of the invention is that, in addition to or in some cases separate from producing oil, the equipment of the present invention may be used to produce valuable hydrocarbon byproducts from tar sands including cleaners, solvents, and other valuable chemicals used in various industrial, oilfield, and pipeline operations. Another significant advantage of the invention is that the system does not require specialized equipment, but rather utilizes components which are generally readily available from a variety of sources.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system for recovering hydrocarbons from a hydrocarbon containing material, the system comprising:

a heated enclosure having an interior chamber;

an input conveyor for inputting the material to the heated enclosure, the heated enclosure housing a flow line therein with a temperature gradient along the flow line of at least 150 F.°, thereby producing hydrocarbon vapors and stripped solids as the material is moved along the flow line;

a heated rotary drum in fluid communication with the flow line for receiving the material from the flow line, the rotary drum having an interior temperature of from 760° F. to 840° F. for generating further hydrocarbon vapors and stripped solids;

a condenser in fluid communication with both the flow line and the rotary drum for receiving the vapors from the flow line and the rotary drum and outputting liquids including hydrocarbons;

a discharge conveyor for discharging the stripped solids from the rotary drum;

one or more input control valves for sealing vacuum downstream from the one or more input conveyors, each input control valve having one or more axially spaced closure gates for redundant sealing downstream from the input conveyor;

one or more discharge control valves for sealing vacuum upstream from the one or more discharge conveyors, each discharge control valve having two or more axially spaced closure gates for the redundant sealing upstream from the discharge conveyor; and a vacuum pump for maintaining a selected vacuum of less than 5 inches of water between the one or more input valves and the one or more discharge valves, such that hydrocarbon vapors are drawn from the flow line and the rotary drum into the condenser.

2. The system as defined in claim 1, wherein a drum sensor senses a temperature within the rotating drum; and material movement through the enclosure is controlled as a function of the measured drum temperature.

3. The system as defined in claim 1, further comprising:

a substantially vertical input conveyor in fluid communication with the one or more input control valves for providing a plug of tar sands for minimizing vacuum loss; and a substantially vertical waste conveyor in fluid communication with the one or more discharge control valves for providing a plug of stripped solids for minimizing vacuum loss.

4. The system as defined in claim 1, wherein each of the input conveyor, the discharge conveyor, and one or more heated conveyors within the flow line, includes a rotary auger.

5. The system as defined in claim 4, wherein each rotary auger is rotated by a drive motor and gearbox, a seal engaging a rotary shaft connected to each auger for sealing vacuum, and a sealed enclosure downstream from the seal for containing gases which pass by the seal.

6. The system as defined in claim 1, wherein the flow line extends in one axial direction and in a substantially opposing axial direction within the heated chamber.

7. The system as defined in claim 1, further comprising:

a nitrogen supply system to supply nitrogen to stripped sands discharged from the discharge conveyor.

8. The system as defined in claim 1, further comprising:

a condensing column upstream of the condenser for separating liquids and gases, hydrocarbon vapors being input into a lower portion of the condensing column.

9. The system as defined in claim 1, further comprising:

a steam line for inputting steam at a temperature of greater than 800° F. into the rotary drum.

10. A system for recovering hydrocarbons from a hydrocarbon containing material, the system comprising:

a heated enclosure having an interior chamber and a plurality of internal baffles within the heated chamber;

an input conveyor for inputting material to the heated enclosure;

a flow line within the heated enclosure in fluid communication with the input conveyor for receiving material and positioned with respect to the plurality of baffles to provide a temperature gradient along the flow line of 150° F., thereby producing hydrocarbon vapors and stripped solids;

a conveyor within the flow line mechanically moving the material along the flow line;

a heated rotary drum in fluid communication with the flow line for receiving the material from the flow line, the drum having an interior temperature of from 760° F. to 840° F. for generating hydrocarbon vapors and stripped solids;

a steam hue for inputting steam at a temperature of greater that 800° F. into the rotary drum;

a condenser in fluid communication with both the flow line and the rotary drum for receiving the vapors from the flow line and the rotary drum and outputting liquids including hydrocarbons and gas including hydrocarbons; and a discharge conveyor for discharging the stripped solids from the rotary drum.

11. The system as defined in claim 10, further comprising:

an input control valve positioned along the input conveyor for sealing vacuum downstream from the input conveyor, the input control valve having two or more axially spaced closure gates; and a discharge control valve positioned along the discharge conveyor for sealing vacuum upstream from the discharge conveyor, the discharge control valve having two or more axially spaced closure gates.

12. The system as defined in claim 10, further comprising:

a substantially vertical input conveyor in fluid communication with one or more input control valves for providing a plug of tar sands for minimizing vacuum loss; and a substantially vertical waste conveyor in fluid communication with one or more discharge control valves for providing a plug of stripped solids for minimizing vacuum loss.

13. The system as defined in claim 10, further comprising:

a flow meter for measuring a flow rate of hydrocarbon vapors to the condenser.

14. The system as defined in claim 10, wherein the flow line extends in one axial direction and in a substantially opposing axial direction within the heated chamber.

15. A system for recovering hydrocarbons from hydrocarbon containing material, the system comprising:

a heated enclosure having an interior chamber;

an input conveyor for inputting material, to the heated enclosure;

a flow line within the heated enclosure in fluid communication with the input conveyor for receiving material to provide a temperature gradient along the flow line of 150° F., thereby producing hydrocarbon vapors and stripped solids;

a heated rotary drum in fluid communication with the flow line for receiving the material from the flow line, the rotary drum having an interior temperature of from 760° F. to 840° F. for generating hydrocarbon vapors and stripped solids;

a condenser in fluid communication with both the flow line and the rotary drum for receiving the vapors and outputting liquids including hydrocarbons and gas including hydrocarbons;

a discharge conveyor for discharging the stripped solids;

an input control valve positioned along the input conveyor for scaling vacuum downstream from the input conveyor;

a discharge control valve positioned along the discharge conveyor for sealing vacuum upstream from the discharge conveyor;

a vacuum pump for maintaining a selected vacuum between the input valve and the discharge valves, such that hydrocarbon vapors are drawn from the flow line and the rotary drum into the condenser;

a flow meter for measuring a flow rate of hydrocarbon vapors to the condenser;

each of the input conveyor, the discharge conveyor, and one or more heated conveyors within the flow line, includes a rotary auger;

a flow rate sensor for sensing the speed of each rotary auger and outputting a flow rate signal; and a processor for controlling a flow rate of material through the system in response to the flow meter and the flow rate signal.

16. The system as defined in claim 15, wherein a portion of one of the gas including hydrocarbons and the liquids including hydrocarbons are input to a burner within the heated closure.

17. The system as defined in claim 15, wherein the flow line extends in one axial direction and in a substantially opposing axial direction within the heated chamber.

18. The system as defined in claim 15, further comprising:

a condensing column upstream of the condenser for separating liquids and gases, hydrocarbon vapors being input into a lower portion of the condensing column.

* * * * *